US009053587B2

(12) United States Patent
Alnadwi

(10) Patent No.: US 9,053,587 B2
(45) Date of Patent: Jun. 9, 2015

(54) REMOTELY ACTUATED DOOR LOCK

(71) Applicant: UMM AL-QURA UNIVERSITY, Makkah (SA)

(72) Inventor: Ahmad Hamood Abdullah Alnadwi, Jeddah (SA)

(73) Assignee: UMM AL-QURA UNIVERSITY, Makkah (SA)

( * ) Notice: Subject to any disclaimer, the term of this patent is extended or adjusted under 35 U.S.C. 154(b) by 201 days.

(21) Appl. No.: 13/629,359

(22) Filed: Sep. 27, 2012

(65) Prior Publication Data

US 2014/0085087 A1 Mar. 27, 2014

(51) Int. Cl.
*G07C 9/00* (2006.01)
*E05B 47/00* (2006.01)

(52) U.S. Cl.
CPC ..... *G07C 9/00309* (2013.01); *E05B 2047/0094* (2013.01)

(58) Field of Classification Search
USPC ..... 340/542, 541, 5.32, 5.61; 70/432; 92/5; 200/61.64
See application file for complete search history.

(56) References Cited

U.S. PATENT DOCUMENTS 4,303,909 A 12/1981 Martin
4,931,789 A 6/1990 Pinnow
5,987,818 A 11/1999 Dabideen
6,005,306 A 12/1999 Pickard
6,072,402 A * 6/2000 Kniffin et al. ..... 340/5.28
6,212,923 B1 4/2001 Clark
6,853,853 B1 2/2005 Van Wiemeersch et al.
8,058,971 B2 * 11/2011 Harkins et al. ..... 340/5.73
8,120,459 B2 * 2/2012 Kwak ..... 340/5.2
8,126,450 B2 2/2012 Howarter et al.
8,674,830 B2 * 3/2014 Lanham et al. ..... 340/540
8,717,154 B2 * 5/2014 Lin ..... 340/426.1
2011/0050419 A1 * 3/2011 Ng et al. ..... 340/542
2012/0234058 A1 * 9/2012 Neil et al. ..... 70/91
2013/0052979 A1 * 2/2013 Chiang et al. ..... 455/404.1

* cited by examiner

*Primary Examiner* — Jennifer Mehmood
*Assistant Examiner* — Omar Casillashernandez
(74) *Attorney, Agent, or Firm* — Richard C Litman

(57) ABSTRACT

A remotely actuated door lock is provided. The remotely actuated lock includes a transceiver for establishing telephone communication with a remote telephone and for receiving a transmitted identification code therefrom. The door lock includes a microprocessor, a programmable logic controller or the like for comparing the transmitted identification code with a stored identification code stored in memory associated with the processor or controller. The door lock further includes a lock bolt actuator in communication with a lock bolt for changing a state of the door lock. The lock bolt actuator is selectively actuated if the transmitted identification code matches the stored identification code. However, if the transmitted identification code does not match the stored identification code, then the transceiver transmits a first alert message to a user, alerting the user to possible unauthorized access.

13 Claims, 3 Drawing Sheets

REMOTELY ACTUATED DOOR LOCK

BACKGROUND OF THE INVENTION

1. Field of the Invention

The present invention relates to locks, and particularly to a remotely actuated door lock.

2. Description of the Related Art

Access to secured locations is typically controlled by the use of locks that prevent the opening of access ports, doors or gates. Such locks are typically keyed or combination-controlled locks, where the lock will only open when the proper key or combination is used. Coded locks, where a key code is input to a control module and the control module signals or triggers the opening or dosing of the lock, are also known. For keyed, combination or coded locks, though, actual physical access to the lock is required for the opening or closing thereof. In other words, the user must be physically present to use the key or enter the combination or code.

There are numerous situations in which a user desires to either lock or unlock a door remotely. For example, if the user is traveling and wishes to allow access those who are still local to the secure region of interest, it would be both convenient and secure for the user to be able to remotely unlock the lock without leaving a copy of the key, or without providing the combination or code to others. Although remote systems for unlocking and locking of doors are known in the field of vehicle doors and locks, such systems are still intended for relatively local use, with a limited range on the order of meters.

Further, such lock actuation systems are limited in their functionality, only allowing the user to lock and unlock the door, but without providing additional security features. If a user is traveling or is otherwise far from the secure area, it would be desirable to provide the user not only with remote locking and unlocking capabilities, but also with an integrated alert system, allowing the same system to be used for sending notifications to the user when unauthorized access is detected.

Thus, a remotely actuated door lock solving the aforementioned problems is desired.

SUMMARY OF THE INVENTION

The remotely actuated door lock includes a transceiver for establishing telephone communication with a remote telephone and for receiving a transmitted identification code therefrom. The transmitted identification code may be a personal identification number (PIN) or the like. The door lock includes a microprocessor, a programmable logic controller or the like for comparing the transmitted identification code with an authorization code stored in non-transitory memory associated with the processor or controller.

The door lock further includes a lock bolt actuator, such as a linear actuator or the like, in communication with a lock bolt for changing a state of the door lock. The lock bolt actuator is selectively actuated if the transmitted identification code matches the authorization code. However, if the transmitted identification code does not match the authorization code, then the transceiver transmits a first alert message to a user, alerting the user to possible unauthorized access. In addition to the first alert message, the door lock includes a sensor or the like for continuously monitoring the door lock, and if physical or other electronic or wireless unauthorized access to the door lock is detected, then the transceiver transmits a second alert message to the user.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
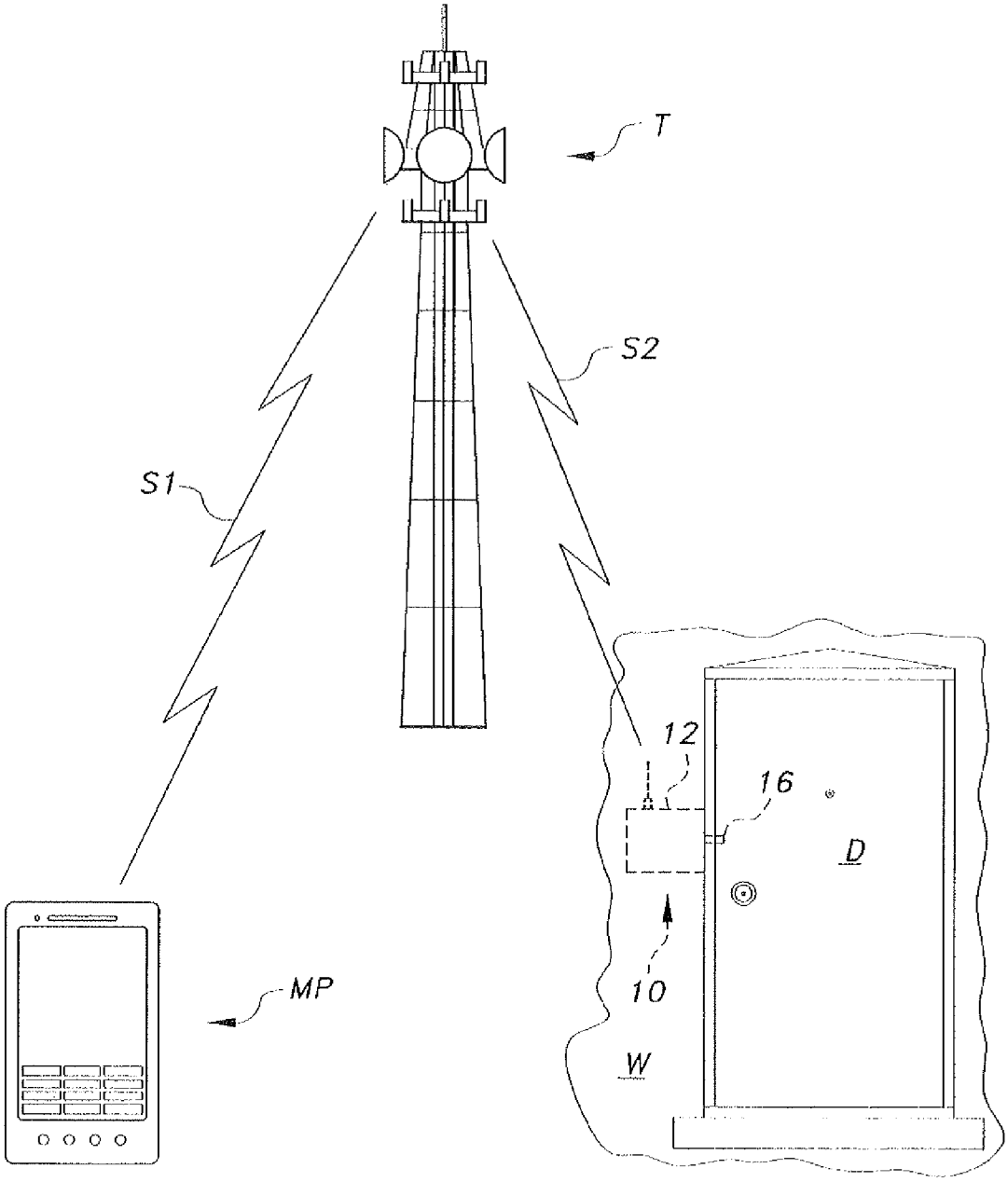
FIG. 1 is a schematic diagram showing remote use of a remotely actuated door lock according to the present invention.
Figure 2:
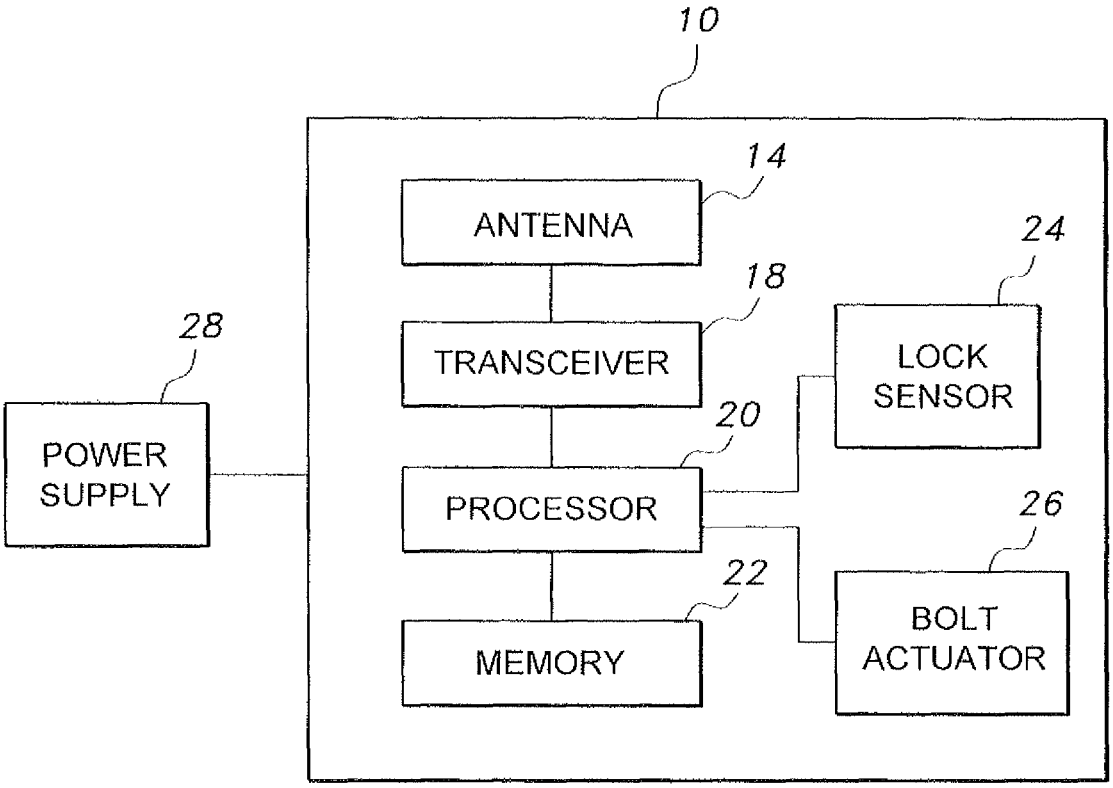
FIG. 2 is a block diagram illustrating system components of the remotely actuated door lock according to the present invention.

As shown in FIGS. 1 and 2, the remotely actuated door lock 10 includes a transceiver 18 for establishing telephone communication with a remote telephone and for receiving a transmitted identification code therefrom. In FIG. 1, an exemplary mobile phone MP is shown transmitting a first signal S1 to an exemplary cellular tower T, which then transmits (or re-transmits) signal S2 to the antenna 14 of the transceiver 18. It should be understood that this transmission in FIG. 1 is shown for exemplary purposes only, and that any suitable type of wireless or wired communication may be established, along with any associated telephone switching exchanges or the like.

Upon establishing communication between the mobile phone MP (or any other suitable type of telephone or device, portable or otherwise), the user transmits the transmitted identification code, preferably by direct entry into the telephone or device. However, it should be understood that the identification code may alternatively be automatically transmitted directly, the identification code being stored in memory of the phone or device. The transmitted identification code may be a personal identification number (PIN) or the like.

As shown in FIG. 2, the door lock 10 includes a processor 20, which be a microprocessor, a microcontroller, a programmable logic controller or the like, for comparing the transmitted identification code with an authorization code stored in non-transitory memory 22 connected to the processor 20. The authorization code may be pre-programmed into memory at the time of manufacture, or the memory 22 may be programmable so that the owner of the door lock 10 may specify the authorization code. Non-transitory memory 22 may be any suitable type of computer readable and programmable memory. Calculations are performed by the processor 20, which may be any suitable type of computer processor.

The processor 20 may be associated with, or incorporated into, any suitable type of computing device, for example, a personal computer or a programmable logic controller. The processor 20, the memory 22, the transceiver 18 and any associated computer readable recording media are in communication with one another by any suitable type of data bus, as is well known in the art.

Examples of computer-readable recording media include a magnetic recording apparatus, an optical disk, a magneto-optical disk, and/or a semiconductor memory (for example, RAM, ROM, etc.). Examples of magnetic recording apparatus that may be used in addition to memory 22, or in place of memory 22, include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW.

In FIG. 1, the door lock 10 is shown mounted within a wall W adjacent a conventional door D. A lock bolt 16 of the door lock 10 engages the door D or doorframe in a conventional manner. It should be understood that this arrangement is shown for exemplary purposes only, and that the door lock 10 may be mounted in any suitable manner, and may be used in combination with any suitable type of door, including conventional house doors, such as that shown in FIG. 1, vehicle doors or the like. Additionally, any suitable type of power supply 28 may be used to power the door lock 10, such as a conventional wired household or building power supply, a battery supply or the like.

The door lock 10 further includes a lock bolt actuator 26, such as a linear actuator or the like, in communication with the lock bolt 16 for changing the state of the door lock 10 from open to closed and vice versa. The lock bolt actuator 26 is selectively actuated by control signals generated by the processor 20 if the transmitted identification code matches the stored authorization code. If the door lock 10 is initially in a locked state, then the lock bolt actuator 26 disengages the lock bolt 16 if the transmitted identification code matches the stored authorization code. Similarly, if the door lock 10 is initially in an unlocked state, then the lock bolt actuator 26 engages the lock bolt 16 if the transmitted identification code matches the stored authorization code. It should be understood that the transceiver 18 and the lock bolt actuator 26 may be any suitable type of transceiver and electronic lock actuator.

Examples of electronic locks are shown in U.S. Pat. Nos. 6,853,853 and 8,126,450, and in published U.S. Patent Application Nos. 2009/0217718 and 2005/0099262, each of which is hereby incorporated by reference in its entirety.

However, if the transmitted identification code does not match the stored authorization code, then the transceiver 18 transmits a first alert message to a user-specified address, alerting the user to possible unauthorized access. In addition to the first alert message, the door lock 10 includes a sensor 24 or the like for continuously monitoring the door lock 10, and if physical or other electronic or wireless unauthorized access to the door lock 10 is detected, then the transceiver 18 transmits a second alert message to a user-specified address. The first and second alert messages may be SMS (Short Message Service) text messages or the like. The sensor 24 may be any suitable type of lock sensor, such as those conventionally used with electronic vehicle locks, household security systems or the like. Examples of such sensor systems are shown in U.S. Pat. Nos. 4,303,909 and 6,212,923, each of which is hereby incorporated by reference in its entirety. The second alert message may be transmitted in other pre-programmed conditions, such as if the door lock 10 is detected to be broken.

Figure 3:
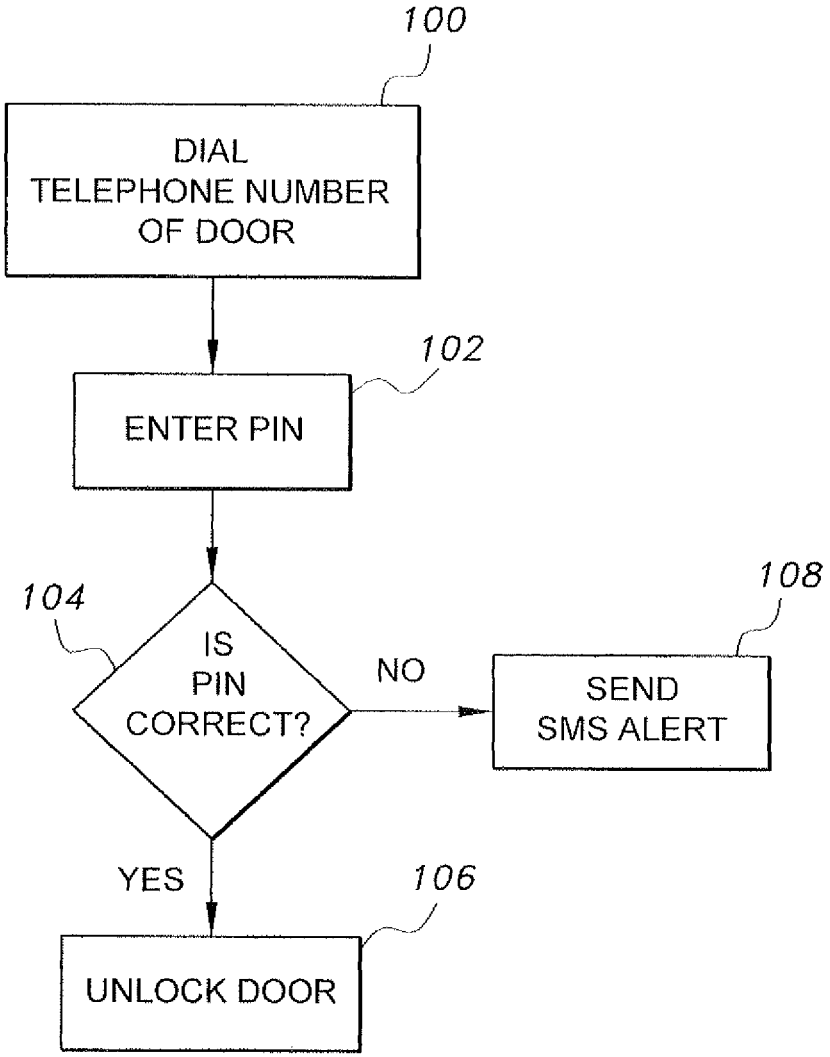
FIG. 3 is a flowchart illustrating a method of remotely actuating a door lock according to the present invention.

As noted above, the user may initially connect to the door lock 10 by any suitable type of wired or wireless communication. In a preferred embodiment, the user dials a particular telephone number associated with the door lock 10 (step 100 in FIG. 3). Communication is then established by wireless or wired telephone communication. At step 102, the user enters his or her identification code, which may be a PIN or the like. The transmitted PIN is then compared, at step 104, by processor 20, against a stored authorization code, which is recorded in memory 22.

At step 106, if the door lock 10 is initially in a locked state, then the lock bolt actuator 26 disengages the lock bolt 16 if the transmitted identification code matches the stored authorization code. Similarly, if the door lock 10 is initially in an unlocked state, then the lock bolt actuator 26 engages the lock bolt 16 if the transmitted identification code matches the stored authorization code. If, however, the transmitted identification code does not match the stored authorization code, then the transceiver 18 transmits a first alert message to a user-specified address, alerting the user to possible unauthorized access (at step 108).

It is to be understood that the present invention is not limited to the embodiments described above, but encompasses any and all embodiments within the scope of the following claims.

I claim:

1. A method of remotely actuating a door lock, consisting the steps of:

establishing telephone communication with a door lock actuating mechanism by dialing a telephone number associated with the door lock;

transmitting an identification code to the door lock actuating mechanism;

comparing the transmitted identification code with an authorization code stored in the door lock actuating mechanism;

activating the door lock actuating mechanism to change a state of the door lock when the transmitted identification code matches the stored authorization code;

transmitting a first alert message without changing the state of the door lock when the transmitted identification code does not match the stored authorization code; monitoring the door lock continuously; detecting unauthorized access to the door lock, and transmitting a secondary alert message to a user specified address when unauthorized access is detected;

wherein the step of transmitting the first alert message and the step of transmitting the second alert message each consists of transmitting a text message to a user-specified address.

2. The method of remotely actuating a door lock as recited in claim 1, wherein the step of transmitting the identification code to the door lock comprises transmitting a personal identification number to the door lock actuating mechanism.

3. The method of remotely actuating a door lock as recited in claim 1, wherein the step of activating the door lock actuating mechanism comprises the steps of:

locking the door lock when an initial state of the door lock is an unlocked state; and unlocking the door lock when the initial state of the door lock is a locked state.

4. A remotely actuated door lock, comprising:

a door lock;

a door lock actuating mechanism connected to the door lock;

a transceiver; and a controller connected to the door lock actuating mechanism and the transceiver, the controller having:

memory;

means for comparing an identification code received by the transceiver with an authorization code stored in the memory;

means for generating a first alert when the received identification code is not the same as the authorization code;

a sensor configured to continuously monitor the door lock and to generate a signal to said controller when the sensor detects tampering with the door lock;

means for generating a second alert when a signal is received from the sensor signifying tampering with the door lock;

wherein the first alert message and the second alert message each consists of a text message transmitted to a user-specified address; and means for activating the door lock actuating mechanism to toggle the door lock between a locked state and an unlocked state when the received identification code is the same as the authorization code stored in the memory.

5. The remotely actuated door lock as recited in claim 4, wherein the authorization code comprises a personal identification number.

6. The remotely actuated door lock as recited in claim 4, wherein the first alert comprises a text message, said controller further comprising means for activating the transceiver to transmit the text message to a user-specified address programmed into said memory.

7. The remotely actuated door lock as recited in claim 4, wherein the second alert comprises a text message, said controller further comprising means for activating the transceiver to transmit the text message to a user-specified address programmed into said memory.

8. A remotely actuated door lock, comprising:

a door lock;

a door lock actuating mechanism connected to the door lock;

a transceiver; and a controller connected to the door lock actuating mechanism and the transceiver, the controller consisting of: memory;

means for comparing an identification code received by the transceiver with an authorization code stored in the memory;

means for activating the door lock actuating mechanism to toggle the door lock between a locked state and an unlocked state when the received identification code is the same as the authorization code stored in the memory; and a sensor configured to continuously monitor the door lock and to generate a signal to said controller when the sensor detects tampering with the door lock wherein signal is selected from the group consisting of a first alert message and a second alert message, wherein each text message is transmitted to a user-specified address.

9. The remotely actuated door lock as recited in claim 8, wherein the authorization code comprises a personal identification number.

10. The remotely actuated door lock as recited in claim 8, wherein said controller generating a first alert when the received identification code is not the same as the authorization code.

11. The remotely actuated door lock as recited in claim 10, wherein the first alert comprises a text message, said controller being coupled for activating the transceiver to transmit the text message to a user-specified address programmed into said memory.

12. The remotely actuated door lock as recited in claim 8, wherein said controller generating a second alert when a signal is received from said sensor signifying tampering with the door lock.

13. The remotely actuated door lock as recited in claim 12, wherein the second alert comprises a text message, said controller being coupled for activating the transceiver to transmit the text message to a user-specified address programmed into said memory.

* * * * *